United States Patent [19]

Kojima et al.

[11] 4,293,793

[45] Oct. 6, 1981

[54] FLUORESCENT DISPLAY TUBE

[75] Inventors: Masayuki Kojima; Masaki Kobayakawa; Kozo Tanaka, all of Izumi, Japan

[73] Assignee: Nippon Electric Co., Ltd., Tokyo, Japan

[21] Appl. No.: 36,510

[22] Filed: May 7, 1979

[30] Foreign Application Priority Data

May 10, 1978 [JP] Japan ..... 53-63100[U]

[51] Int. Cl.[3] ..... H01J 19/38; H01J 63/06

[52] U.S. Cl. ..... 313/497

[58] Field of Search ..... 313/497, 496

[56] References Cited

U.S. PATENT DOCUMENTS 4,045,704 8/1977 Kishino et al. ..... 313/497

4,047,073 9/1977 Kishino ..... 313/497

4,155,026 5/1979 Nixon ..... 313/497 X

FOREIGN PATENT DOCUMENTS 1245309 9/1971 United Kingdom ..... 313/497

*Primary Examiner*—Palmer C. Demeo

*Attorney, Agent, or Firm*—Fitzpatrick, Cella, Harper & Scinto

[57] ABSTRACT

In order to suppress the Barkhausen oscillation previously observed in fluorescent display tubes, the electron-stream transmission of the grid electrode is controlled by shielding regions of solid or fine mesh form provided in each of the grid meshes in opposing relationship to the exposed insulating portions of the anode substrate lying within the corresponding set of anode segments, which are arranged in a pattern of substantially figure-of-eight configuration.

8 Claims, 6 Drawing Figures

FLUORESCENT DISPLAY TUBE

BACKGROUND OF THE INVENTION

This invention relates to fluorescent display tubes of the type commonly employed to display data in numeric and/or letter form.

A typical form of fluorescent display tube includes an anode substrate coated with a fluorescing substance (FIG. 1), a grid spacer (FIG. 2) placed over the substrate and the mesh of a grid electrode (FIG. 3) laid over the grid spacer. Other parts such as a cathode and a support structure as assembled on the stack to complete an electrode assembly, and a glass covering is sealingly secured to the electrode assembly. Such configuration is fully described by Takao Kishino in U.S. Pat. No. 4,047,073 (Patented on Sept. 6, 1977). As is well known, the display tube is evacuated at the last stage of manufacture through a gas exhausting tube attached thereto. The anode arrangement of the display tube includes a number of segmented luminescent anodes or groups of anode segments and, in operation, only those anode segments which are held at positive potential are excited to emit light by bombardment of the electrons emitted from the cathode and accelerated by the control-grid potential, as the anode segments in each group are selectively excited to display a numeral or letter desired.

In other words, in operation of the fluorescent display tube, the anode segments in each group never emit light all at the same time and the combination of anode segments selected or excited to emit light by electron bombardment usually varies from time to time to display different numerals or letters in turns. In some case, any of the anode segments in some group or other is not excited so that there is no display in the digit place. Specifically, with the conventional mesh pattern of grid electrode (FIG. 3), among the electrons emitted from the cathode and proceeding through the mesh under the acceleration effect of the grid potential, those electrons approaching the anode segments held at positive potential excite such segments effectively and thereby cause them to emit light, but the remaining electrons passing through the mesh and approaching the other segments, not held at positive potential, and the exposed insulating surface (FIG. 1) of the anode substrate are attracted back to the grid electrode. Such behavior of electrons, occurring in repetition, gives rise to a sort of oscillation, which is known as Barkhausen oscillation. Such oscillation is particularly observed in the VHF range, though limited in intensity. In cases where such display tubes are employed with televisions or other electronic appliances utilizing such frequency range, weak electric waves resulting from the Barkhausen oscillation give rise to practical problems, impeding the performance of the associated appliance to a marked extent.

SUMMARY OF THE INVENTION

It is therefore, an object of this invention to provide a fluorescent display tube suppressing the Barkhausen oscillation.

It is another object of this invention to provide a fluorescent display tube comprising improved grid members having a fine mesh region and thereby suppressing the Barkhausen oscillation without disturbing a field of vision.

Briefly, those objects of the invention are achieved by providing shielding regions of fine mesh in each of the grid meshes in opposing relation to the exposed insulating portions of the anode substrate lying within the corresponding set of anode segments.

The above and other objects, features and advantages of the present invention will become apparent from the following description when taken in conjunction with the accompanying drawings.

DESCRIPTION OF THE PREFERRED EMBODIMENTS

Figure 1:
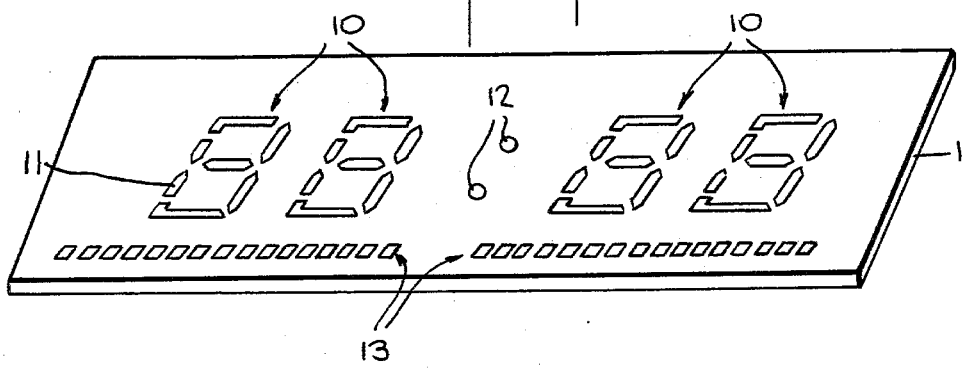
FIG. 1 is a perspective view of an anode structure of a fluorescent display tube.

Referring now to FIG. 1, a number of groups of anode segments 11 are arranged on the anode substrate 1 in an array of patterns of substantially figure-of-eight configuration 10 and dots 12. Needless to say, a fluorescent material is provided on each of the indicating portions 10 and 12. Each anode segment 11 is electrically connected to an array of connecting portions 13 formed on the anode substrate 1. In FIG. 1, those connecting means are not shown.

Figure 2:
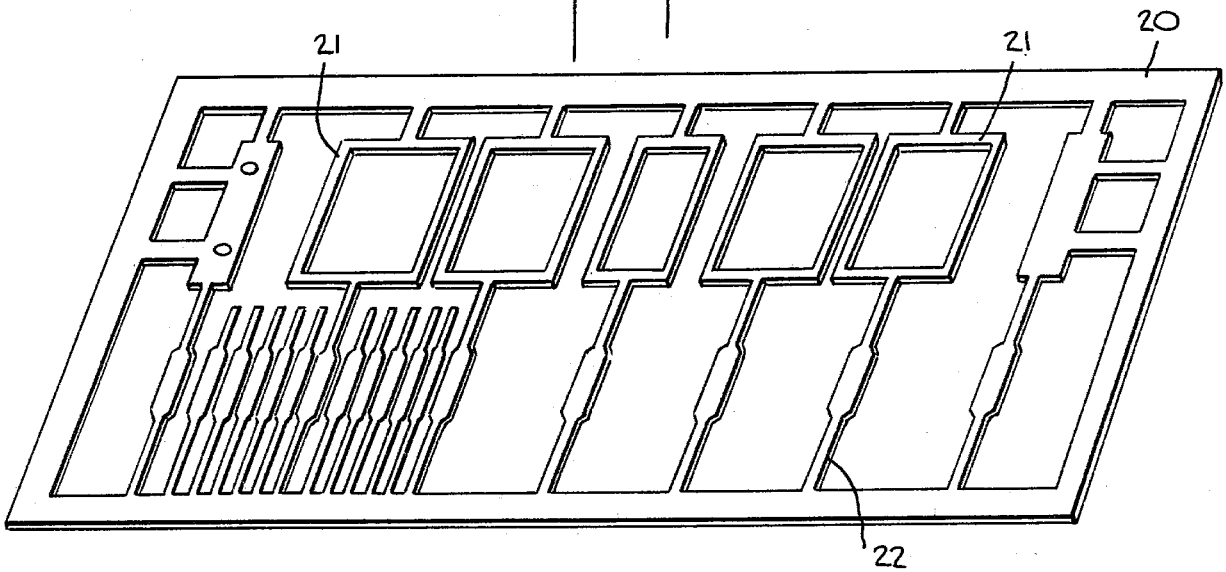
FIG. 2 is a perspective view of a spacer frame having grid spacers and lead-in wires.
Figure 3:
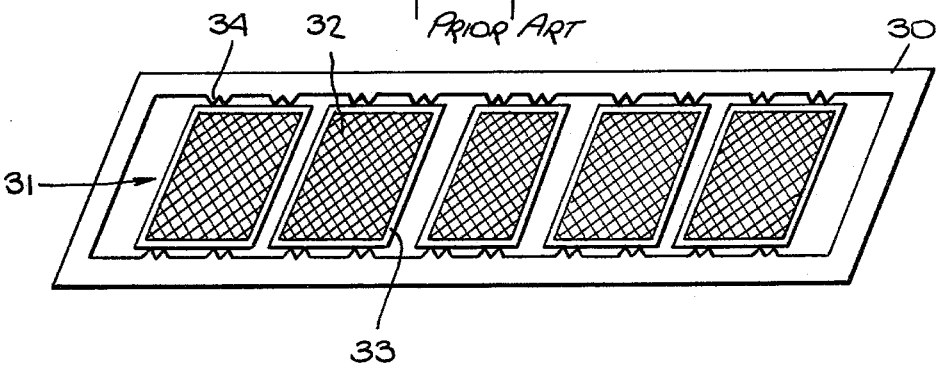
Fig. 3. PRIOR ART
FIG. 3 is a perspective view of a conventional grid frame having an array of mesh patterns.

Referring to FIG. 2, an array of grid spacers 21 is supported by spacer frame 20. Each spacer 21 has a grid terminal lead-in wire 22. In FIG. 3, an array of conventional grids 31 is supported by grid frame 30. Each grid 31 comprises a uniform pattern of mesh region 32 surrounded by mesh frame 33. The mesh region 32 has enough area to cover whole region of indicating portions 10 and 12.

Referring to FIG. 2 and FIG. 3, as is described in the aforementioned Kishino Patent, a grid frame 30 is put over a spacer frame 20, and after placing each grid 31 upon each spacer 21 and securing them by welding or caulking, a grid member is formed by removing unnecessary portions, namely, frames 20 and 30 and holding piece 34 combined to each mesh frame 33.

Figure 4:
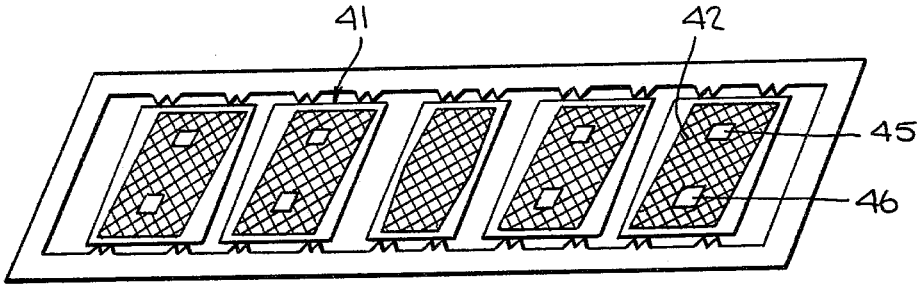
FIG. 4 is a perspective view of a grid frame according to one embodiment of the present invention.

One of the preferred embodiments of the present invention can be achieved by replacing the conventional grid 31 by a newly invented grid shown in FIG. 4. A new grid 41 is generally of the same pattern of mesh arrangement as shown in FIG. 3, but its mesh region 42 includes solid shielding regions 45 and 46 which allow no passage of electrons.

In operation of a fluorescent display tube employing such a grid electrode, it is to be noted that electrons tending to pass through the meshes 42 in the vicinity of any anode segments 11 having no positive potential are attracted by the shielding regions 45 and 46 while electron passage to the insulating regions of the anode substrate 1 that lie within the set of anode segments 11 is precluded by the solid shielding regions 45 and 46. Because of this, it will be readily appreciated that there is no occurrence of any negative electrical resistance and the Barkhausen oscillation is effectively suppressed.

Figure 5:
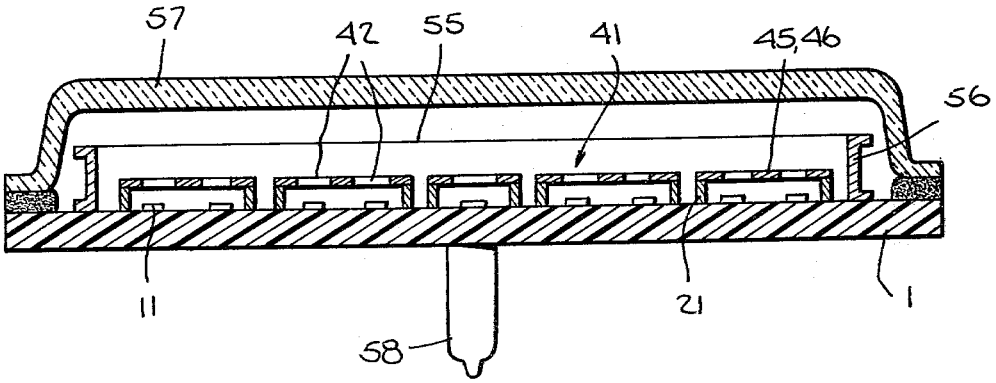
FIG. 5 is a cross-sectional view of a fluorescent display tube employing the improved grid electrodes shown in FIG. 4.

In FIG. 5, which illustrates a fluorescent display tube embodying the principles of the present invention, the anode substrate 1 of FIG. 1 with sets of anode segments 11 arranged thereon, the grid spacer 21 of FIG. 2 and the grid 41 of FIG. 4 are used. Other parts, such as a cathode wire 55, cathode supports 56 and a glass covering 57 are located in a conventional manner. A tube 58 for exhausting gases is attached to the substrate 1 and sealed off after the evacuation process.

As will be understood from the above description, when the electron passing region is restricted to the area corresponding to the area of the anode segments 11 and 12, Barkhausen oscillation is most effectively suppressed. In that case, however, the field of vision is very narrowly restricted. In this aspect, the areas of the shielding regions 45 and 46 are preferably formed relatively smaller than the area surrounded by the anode segments 11. A typical example of the dimensions of each grid 41 are as follows: the mesh region 42 of $16.5\times10$ mm; the shielding regions 45 and 46 of $3.5\times4$ mm and $4\times4$ mm, respectively; and the mesh frame of $18\times14$ mm. These dimensions are given for a case where the indicating portions 10 have the dimensions of $15\times8.4$ mm.

In the foregoing embodiment, a grid for dot portion 12 has no shielding region because the actual width of the grid is as narrow as 3 mm wide. Furthermore, as shown in FIG. 4, the mesh region 42 is slightly inclined toward the right hand about 10 degrees depending on the inclination of the figure-of-eight portion 10 (FIG. 1), and thereby restricting the electron passage to the outside of portion 10 as much as possible.

Figure 6:
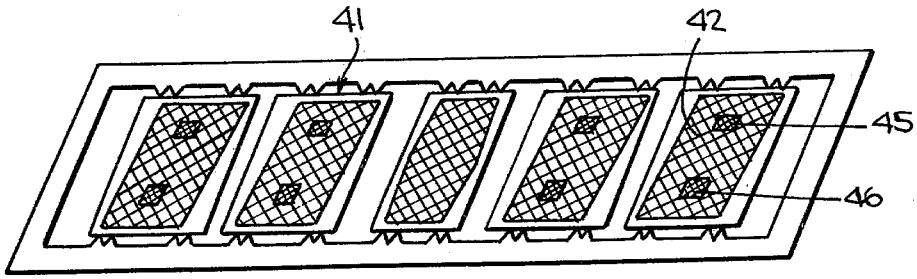
FIG. 6 is a perspective view of another form of a grid frame of the invention.

Although the solid regions 45 and 46 give a excellent shielding effects, it should be noted that the problem of reflection of exterior light by the solid regions 45 and 46 or emission of light themselves may possibly occur. Such problems, however, can easily be dealt with by blackening the solid regions 45 and 46 as, for example, with an appropriate chemical substance or by hydrogen treatment at an elevated temperature. Alternatively, the solid regions 45 and 46 can be replaced by fine mesh regions as shown in FIG. 6. When a mesh pattern is formed like a honeycomb and the length of one side of a hexagonal opening in the region 42 is 0.2 mm, a fine mesh having a shielding effect is obtained by shortening the length of one side of the hexagonal opening to less than 0.15 mm. In that case, the frame width of each opening changes, for instance, from 40 $\mu$m to $90-100$ $\mu$m. Such dimensions are effective in the range of driving voltage below 30 V. Since the driving voltages of the ordinary fluorescent display tube is around 18 V, the latter dimension is practical. If fine mesh regions are employed instead of solid regions, the field of vision is improved greatly. It will be apparent to those skilled in the art that the invention is not restricted to the features described above and shown in the drawings but may be varied in many ways within the scope of the annexed claim.

What is claimed is:

1. In a fluorescent display tube, an anode substrate having at least one display pattern of anode segments mounted thereon, said anode segments being excitable to emit light by electron bombardment, said anode substrate having insulating regions within the pattern of anode segments, a cathode member extending over said anode substrate and said anode segments, and a grid member disposed between said anode substrate and said cathode member, said grid member having electron passage regions of relatively open mesh structure lying over said anode segments for permitting electrons to pass through to said anode segments, said grid member having shielding regions of relatively fine mesh structure lying over said anode substrate insulating regions within said pattern of anode segments, said shielding regions being characterized in that they inhibit passage of electrons to said anode substrate while permitting light to pass therethrough.

2. The device of claim 1, wherein said mesh structure in both said electron passage regions and said shielding regions is formed in honeycomb patterns defining hexagonal openings therethrough.

3. The device of claim 2, further wherein the length of one side of the hexagonal openings through the mesh in said electron passage regions is 0.2 mm and the length of one side of the hexagonal openings through the mesh in said shielding regions is less than 0.15 mm.

4. The device of claim 1, wherein said shielding regions are smaller than said underlying anode substrate insulating regions within said pattern of anode segments.

5. The device of claim 1, wherein said display pattern of anode segments comprises generally a figure-of-eight configuration.

6. The device of claim 5, wherein said figure-of-eight configuration of said anode segment display pattern is inclined and wherein further said electron passage regions and shielding regions are likewise inclined.

7. The device of claim 1, wherein the respective areas of said electron passage regions are not less than the respective corresponding underlying anode segments, and wherein the respective areas of said shielding regions are not greater than the respective corresponding underlying anode substrate insulating regions.

8. A multi-digit fluorescent display tube comprising an anode substrate having an array of figure-of-eight display patterns of anode segments mounted thereon, said anode segments being excitable to emit light by electron bombardment, said anode substrate having insulating regions within each of the figure-of-eight patterns of anode segments, external regions around the borders of each of said figure-of-eight patterns, a cathode member extending over said anode substrate and said anode segments, and a grid member disposed between said anode substrate and said cathode member, said grid member having electron passage regions of relatively open mesh structure lying over all of said anode segments and over all of said external region of each of said figure-of-eight patterns for permitting electrons to pass through to all of said anode segments, said grid member having shielding regions of relatively fine mesh structure positioned in opposing relationships to and above said insulating regions within each of said figure-of-eight patterns, said fine mesh regions being characterized in that they inhibit passage of electrons to said anode substrate while permitting light to pass therethrough.

* * * * *